US011532256B2

(12) United States Patent
Zhu

(10) Patent No.: US 11,532,256 B2
(45) Date of Patent: Dec. 20, 2022

(54) DISPLAY ASSEMBLY, DISPLAY APPARATUS, AND DISPLAY METHOD AND TRANSMISSION METHOD OF DATA SIGNAL

(71) Applicants: K-Tronics (Suzhou) Technology Co., Ltd., Jiangsu (CN); BOE TECHNOLOGY GROUP CO., LTD., Beijing (CN)

(72) Inventor: Min Zhu, Beijing (CN)

(73) Assignees: K-Tronics (Suzhou) Technology Co., Ltd., Jiangsu (CN); Beijing BOE Technology Development Co., Ltd., Beijing (CN)

( * ) Notice: Subject to any disclaimer, the term of this patent is extended or adjusted under 35 U.S.C. 154(b) by 0 days.

(21) Appl. No.: 17/433,825

(22) PCT Filed: Dec. 7, 2020

(86) PCT No.: PCT/CN2020/134238

§ 371 (c)(1),
(2) Date: Aug. 25, 2021

(87) PCT Pub. No.: WO2021/121064

PCT Pub. Date: Jun. 24, 2021

(65) Prior Publication Data

US 2022/0148480 A1 May 12, 2022

(30) Foreign Application Priority Data

Dec. 20, 2019 (CN) ..... 201911330855.X

(51) Int. Cl.
*G09G 3/20* (2006.01)

(52) U.S. Cl.
CPC ..... *G09G 3/20* (2013.01); *G09G 2310/0267* (2013.01); *G09G 2310/0291* (2013.01);
(Continued)

(58) Field of Classification Search
CPC .. G09G 3/3666; G09G 3/3406; G09G 3/2003; G09G 2360/04; G09G 2300/0443;
(Continued)

(56) References Cited

U.S. PATENT DOCUMENTS 7,804,497 B2 9/2010 Song et al.
9,858,897 B2 * 1/2018 Han ..... G09G 5/006
(Continued)

FOREIGN PATENT DOCUMENTS

CN 101136189 A 3/2008
CN 104050908 A 9/2014
(Continued)

*Primary Examiner* — Shaheda A Abdin
(74) *Attorney, Agent, or Firm* — IP & T Group LLP

(57) ABSTRACT

A display apparatus comprises a display assembly and a main control chip. The display assembly comprises K timing controllers, K data driving circuits and a display panel. Each timing controller is configured to receive a set of pixel data among K sets of pixel data into which an i-th row of pixel data in a frame of image data are divided. A data driving circuit in the K data driving circuits is configured to receive the set of pixel data from a corresponding timing controller and output a set of data voltages. The display panel is configured to receive K sets of data voltages for display. The main control chip comprises a processor configured to receive the frame of image data, divide the i-th row of pixel data into the K sets of pixel data, and simultaneously transmit the K sets of pixel data to the K timing controllers.

15 Claims, 10 Drawing Sheets

(52) U.S. Cl.
CPC ..... *G09G 2310/08* (2013.01); *G09G 2370/04* (2013.01); *G09G 2370/22* (2013.01)

(58) Field of Classification Search
CPC ..... G09G 2320/0673; G09G 2370/08; G09G 2330/021; G09G 2320/103; G09G 2320/0646; G09G 2360/16; G09G 2300/0452; G09G 2320/0233; G09G 2320/0242; G06F 3/1446
See application file for complete search history.

(56) References Cited

U.S. PATENT DOCUMENTS

| | | | | |
|---|---|---|---|---|
| 10,043,459 | B1 * | 8/2018 | de Greef | G09G 3/348 |
| 11,126,288 | B2 * | 9/2021 | Kim | G06F 3/04164 |
| 2013/0314423 | A1 * | 11/2013 | Kim | G09G 5/18 345/204 |
| 2014/0253566 | A1 * | 9/2014 | Chen | G09G 3/2096 345/520 |
| 2015/0339967 | A1 * | 11/2015 | Shin | G09G 3/3666 345/690 |
| 2016/0042711 | A1 * | 2/2016 | Kim | G09G 3/3688 345/88 |
| 2016/0351099 | A1 * | 12/2016 | Kim | G09G 3/2037 |

FOREIGN PATENT DOCUMENTS

| | | | |
|---|---|---|---|
| CN | 106415697 | A | 2/2017 |
| CN | 107529669 | A | 1/2018 |
| CN | 110415661 | A | 11/2019 |

* cited by examiner

DISPLAY ASSEMBLY, DISPLAY APPARATUS, AND DISPLAY METHOD AND TRANSMISSION METHOD OF DATA SIGNAL

CROSS-REFERENCE TO RELATED APPLICATIONS

This application is a national phase entry under 35 USC 371 of International Patent Application No. PCT/CN2020/134238 filed on Dec. 7, 2020, which claims priority to Chinese Patent Application No. 201911330855.X, filed on Dec. 20, 2019, which are incorporated herein by reference in their entirety.

TECHNICAL FIELD

The present disclosure relates to the field of display technologies, and in particular, to a display assembly, a display apparatus, and a display method and a transmission method of a data signal.

BACKGROUND

In the related art, a signal source device such as a video card or a host outputs a signal to a display apparatus. After receiving the signal, a main control chip (Scaler) inside the display apparatus decodes the signal, and then recodes the signal according to a connection interface protocol between the main control chip and a timing controller, and outputs the recoded signal to the timing controller; and afterwards the timing controller controls signal outputs of a gate driving circuit and a data driving circuit.

However, as a resolution and a refresh rate of the signal become higher and higher, a very high bandwidth is required for transmission, but a connection interface between the main control chip and the timing controller cannot currently support such a high bandwidth.

SUMMARY

In a first aspect, a display assembly is provided. The display assembly includes K timing controllers, K data driving circuits and a display panel. Each of the K timing controllers is configured to receive a set of pixel data among K sets of pixel data into which an i-th row of pixel data in a frame of image data are divided, and different timing controllers receive different sets of pixel data; K is a positive integer greater than or equal to 2, i belongs to a set with elements 1, 2, 3, . . . , n ($i \in \{1, 2, 3, \ldots, n\}$), and n is a positive integer greater than or equal to 1. A data driving circuit in the K data driving circuits is connected to a corresponding timing controller in the K timing controllers. The data driving circuit is configured to receive the set of pixel data from the corresponding timing controller and output a set of data voltage. The display panel is electrically connected to the K data driving circuits, and the display panel is configured to receive K sets of data voltages output by the K data driving circuits for display.

In some embodiments, the display assembly further includes a gate driving circuit. The gate driving circuit is electrically connected to a timing controller in the K timing controllers and the display panel. The timing controller connected to the gate driving circuit is further configured to transmit a control signal to the gate driving circuit, and the gate driving circuit is configured to output a gate scanning signal to the display panel according to the control signal received from the timing controller connected to the gate driving circuit, so that when a gate line, connected to an i-th row of pixels, in the display panel receives the gate scanning signal, the i-th row of pixels receive the K sets of data voltages for display.

In some embodiments, the timing controller includes a first embedded display port (eDp) interface, and the first eDp interface is configured to receive the set of pixel data among the K sets of pixel data into which the i-th row of pixel data in the frame of image data are divided.

In some embodiments, the timing controller further includes a first buffer configured to store the set of pixel data received by the timing controller.

In some embodiments, the display panel has a display area divided into K sub-areas in a row direction of pixels in the display panel, and all pixels in each sub-area are electrically connected to one data driving circuit in the K data driving circuits. The timing controller further includes a memory configured to store the number of pixels in an i-th row of pixels in the sub-area where all the pixels electrically connected to the data driving circuit connected to the timing controller are located.

In a second aspect, a display apparatus is provided, and the display apparatus includes the display assembly as described in any of the above embodiments and a main control chip. The main control chip includes a processor. The processor is configured to receive the frame of image data, divide the i-th row of pixel data into the K sets of pixel data, and simultaneously transmit the K sets of pixel data to the K timing controllers in the display assembly.

In some embodiments, the main control chip further includes K second buffers. The i-th row of pixel data include M pixel data. The processor is further configured to: sequentially and respectively store every S pixel data in pixel data from a first pixel datum to an M-th pixel datum among the i-th row of pixel data into a second buffer in second buffers from a first second buffer to a (K−1)-th second buffer, and M is greater than a product of (K−1) and S and is less than or equal to a product of K and S ($(K-1)\times S<M\leq K\times S$), and S and M are both positive integers. S pixel data in each second buffer from the first second buffer to the (K−1)-th second buffer constitute the set of pixel data; and store pixel data from a [(K−1)−S+1]-th pixel datum to the M-th pixel datum among the i-th row of pixel data into a K-th second buffer.

In some embodiments, the processor is further configured to generate $S-[M-(K-1)\times S]$ virtual pixel data and store the $S-[M-(K-1)\times S]$ virtual pixel data into the K-th second buffer. The pixel data from the $[(K-1)\times S+1]$-th pixel datum to the M-th pixel datum and the $S-[M-(K-1)\times S]$ virtual pixel data, which are in the K-th second buffer, constitute the set of pixel data.

In some embodiments, the main control chip further includes K second eDp interfaces, and each of the K timing controllers includes a first eDp interface. A second eDp interface in the K second eDp interfaces is connected to the first eDp interface of one timing controller in the K timing controllers. The processor is further configured to output the set of pixel data among the K sets of pixel data to the first eDp interface of the corresponding timing controller through the second eDp interface in the K second eDp interfaces.

In some embodiments, the display panel has a display area divided into K sub-areas in a row direction of pixels in the display panel, and all pixels in each sub-area are electrically connected to one data driving circuit in the K data driving circuits. The timing controller includes a memory configured to store the number of pixels in an i-th row of pixels in the sub-area where all the pixels electrically connected to the data driving circuit connected to the timing controller are located. The processor is further configured to read the number of pixels in the i-th row of pixels in the sub-area corresponding to each timing controller stored in each timing controller, so that the processor divides the i-th row of pixel data corresponding to the i-th row of pixels into the K sets of pixel data according to the number of the pixels in the i-th row of pixel in the sub-area stored in each timing controller.

In some embodiments, the memory is further configured to store display port configuration data (DPCD) of the timing controller, the DPCD includes the number of lanes and a transmission rate of each lane. The processor is further configured to read the DPCD and obtain a state of the first eDp interface of the timing controller according to the DPCD.

In some embodiments, the processor is further configured to receive a hot-plug detection signal from each of the K timing controllers to determine whether each timing controller is connected to the main control chip.

In a third aspect, a display method of a data signal is provided, and the display method includes: receiving, by the display panel, the K sets of data voltages output by the K data driving circuits for display. A set of data voltages in the K sets of data voltages is output by each of the K data driving circuits according to the set of pixel data received from the corresponding timing controller, and the set of pixel data is a set of pixel data among the K sets of pixel data.

In some embodiments, the display assembly further includes a gate driving circuit, the gate driving circuit is electrically connected to a timing controller in the K timing controllers and the display panel. The display method further includes: receiving, by a gate line connected to an i-th row of pixels in the display panel, a gate scanning signal from the gate driving circuit, so that when the gate line connected to the i-th row of pixels receives the gate scanning signal, the i-th row of pixels receive the K sets of data voltages for display. The gate scanning signal is output by the gate driving circuit according to a control signal received from the timing controller connected to the gate driving circuit, and the control signal is output according to states of (K−1) timing controllers other than the timing controller connected to the gate driving circuit in the K timing controllers.

In a fourth aspect, a transmission method of a data signal is provided, and the transmission method includes: receiving, by the processor, the frame of image data; dividing, by the processor, the i-th row of pixel data into the K sets of pixel data; and transmitting, by the processor, the K sets of pixel data to the K timing controllers in the display assembly simultaneously.

In some embodiments, the main control chip includes K second buffers, and the i-th row of pixel data include M pixel data. The transmission method further includes: storing, by the processor, every S pixel data in pixel data from a first pixel data to an M-th pixel data among the i-th row of pixel data sequentially and respectively into a second buffer in second buffers from a first second buffer to a (K−1)-th second buffer; S pixel data in each second buffer from the first second buffer to the (K−1)-th second buffer constituting the set of pixel data; and storing, by the processor, pixel data from a [(K−1)×S+1]-th pixel datum to the M-th pixel datum among the i-th row of pixel data into a K-th second buffer.

In some embodiments, the transmission method further includes: generating, by the processor, S−[M−(K−1)×S] virtual pixel data; and storing, by the processor, the S−[M−(K−1)×S] virtual pixel data into the K-th second buffer.

In some embodiments, the display panel has a display area divided into K sub-areas in a row direction of pixels in the display panel, and all pixels in each sub-area are electrically connected to one data driving circuit in the K data driving circuits. The timing controller includes a memory configured to store the number of pixels in an i-th row of pixels in the sub-area where all the pixels electrically connected to the data driving circuit connected to the timing controller are located. The transmission method further includes: reading, by the processor, the number of pixels in a row of pixels in the sub-area corresponding to each timing controller stored in each timing controller, so that the processor divides the i-th row of pixel data corresponding to the i-th row of pixels into the K sets of pixel data according to the number of pixels in the i-th row of pixels in the sub-area corresponding to each timing controller.

In some embodiments, the timing controller includes a memory configured to store display port configuration data (DPCD) of the timing controller, and the DPCD includes the number of lanes and a transmission rate of each lane. The transmission method further includes: reading, by the processor, the DPCD; and obtaining, by the processor, a state of a first eDp interface of the timing controller according to the DPCD.

In some embodiments, the transmission method further includes: receiving, by the processor, a hot-plug detection signal from each of the K timing controllers; and determining, by the processor, whether the timing controller is connected to the main control chip according to the hot-plug detection signal.

BRIEF DESCRIPTION OF THE DRAWINGS

In order to describe technical solutions in the present disclosure more clearly, the accompanying drawings to be used in some embodiments of the present disclosure will be introduced briefly below. Obviously, the accompanying drawings to be described below are merely accompanying drawings of some embodiments of the present disclosure, and a person of ordinary skill in the art may obtain other drawings according to these drawings. In addition, the accompanying drawings in the following description may be regarded as schematic diagrams, and are not limitations on actual sizes of products, actual processes of methods and actual timings of signals involved in the embodiments of the present disclosure.

DETAILED DESCRIPTION

Figure 1:
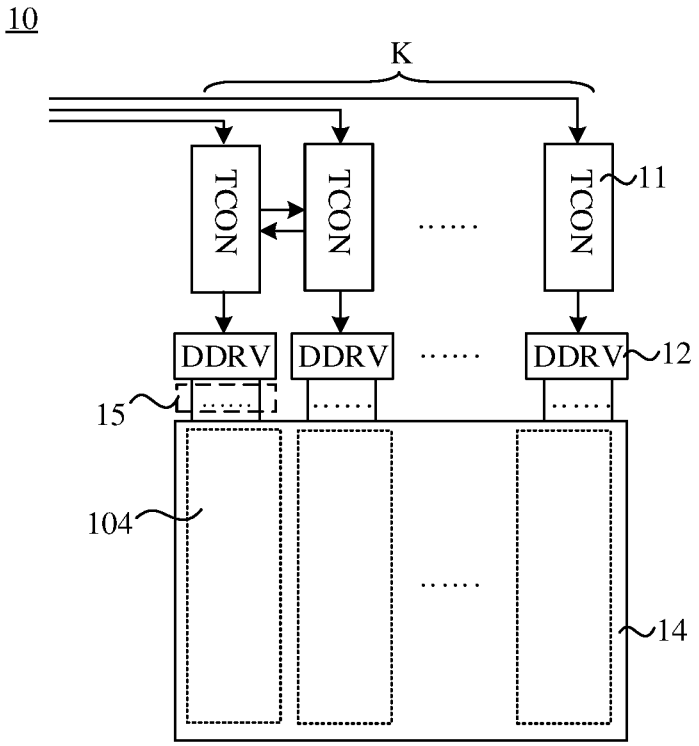
FIG. 1 is a schematic diagram showing a structure of a display assembly, in accordance with some embodiments.

Technical solutions in some embodiments of the present disclosure will be described clearly and completely below with reference to the accompanying drawings. Obviously, the described embodiments are merely some but not all embodiments of the present disclosure. All other embodiments obtained on a basis of the embodiments of the present disclosure by a person of ordinary skill in the art shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to". In the description of the specification, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Hereinafter, terms "first" and "second" are used for descriptive purposes only, and are not to be construed as indicating or implying relative importance or implicitly indicating the number of indicated technical features. Thus, a feature defined by "first" or "second" may explicitly or implicitly include one or more of the features. In the description of the embodiments of the present disclosure, the term "a plurality of" or "the plurality of" means two or more unless otherwise specified.

In the description of some embodiments, the expressions "coupled" and "connected" and their derivatives may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other, but still cooperate or interact with each other. The embodiments disclosed herein are not necessarily limited to the contents herein.

The use of "applicable to" or "configured to" herein means an open and inclusive expression, which does not exclude devices that are applicable to or configured to perform additional tasks or steps.

In addition, the use of the phrase "based on" is meant to be open and inclusive, since a process, step, calculation or other action that is "based on" one or more of the stated conditions or values may, in practice, be based on additional conditions or values exceeding those stated.

Exemplary embodiments are described herein with reference to cross-sectional views and/or plan views as idealized exemplary drawings. In the accompanying drawings, thicknesses of layers and sizes of areas are enlarged for clarity. Exemplary embodiments of the present disclosure should not be construed to be limited to shapes of areas shown herein, but to include deviations in shape due to, for example, manufacturing. For example, an etched area shown as a rectangle generally has a curved feature. Therefore, the areas shown in the accompanying drawings are schematic in nature, and their shapes are not intended to show actual shapes of the area in a device, and are not intended to limit the scope of the exemplary embodiments.

Some embodiments of the present disclosure provide a display assembly 10, and as shown in FIG. 1, the display assembly 10 includes K timing controllers 11, K data driving circuits and a display panel.

Each timing controller 11 in the K timing controllers 11 is configured to receive a set of pixel data among K sets of pixel data into which an i-th row of pixel data in a frame of image data are divided, and different timing controllers receive different sets of pixel data. K is a positive integer greater than or equal to 2, i belongs to a set with elements 1, 2, 3, . . . , n ($i \in \{1, 2, 3, \ldots, n\}$), and n is a positive integer greater than or equal to 1.

For example, the i-th row of pixel data in the frame of image data are divided into K sets of pixel data, a first timing controller 11 receives a first set of pixel data, a second timing controller 11 receives a second set of pixel data, . . . , a K-th timing controller 11 receives a K-th set of pixel data. Herein, the i-th row of pixel data are pixel data in any row in the frame of image data.

For example, each set of pixel data in the K sets of pixel data includes the same number of pixel data. Accordingly, the duration for receiving a corresponding set of pixel data by each timing controller 11 is the same.

If the number of pixel data included in each set of pixel data among the K sets of pixel data is different, a duration for receiving a set of pixel data by a timing controller 11 corresponding to a set including more pixel data is longer, whereas a duration for receiving a set of pixel data by a timing controller 11 corresponding to a set including fewer pixel data is shorter. Thus, there will be a waiting gap before receiving a next row of pixel data, i.e., before receiving an (i+1)-th row of pixel data, which may lead to a problem of pixel data loss. Therefore, that the number of pixel data in each set of pixel data is the same may avoid the problem of pixel data loss due to different reception duration.

As shown in FIG. 1, a data driving circuit 12 in the K data driving circuits 12 is connected to a corresponding timing controller 11 in the K timing controllers 11, and each data driving circuit 12 is configured to receive a set of pixel data from the corresponding timing controller 11 and output a set of data voltages according to the set of pixel data.

For example, a first data driving circuit 12 is connected to a first timing controller 11. The first data driving circuit 12 receives a first set of pixel data from the first timing controller 11, and outputs a first set of data voltages according to the first set of pixel data. A second data driving circuit 12 is connected to a second timing controller 11. The second data driving circuit 12 receives a second set of pixel data from the second timing controller 11, and outputs a second set of data voltages according to the second set of pixel data. By analogy, a K-th data driving circuit 12 is connected to a K-th timing controller 11. The K-th data driving circuit 12 receives a K-th set of pixel data from the K-th timing controller 11, and outputs a K-th set of data voltages according to the K-th set of pixel data.

For example, in addition to receiving a corresponding set of pixel data, each timing controller 11 further receives a vertical synchronization signal VS, a horizontal synchronization signal HS and a data enable signal DE. The timing controller 11 controls a corresponding data driving circuit 12 according to the vertical synchronization signal VS, the horizontal synchronization signal HS and the data enable signal DE, so that the data driving circuit 12 outputs a set of data voltage according to a set of pixel data from the corresponding timing controller 11.

As shown in FIG. 1, the display panel 14 is electrically connected to the K data driving circuits. The display panel 14 is configured to receive K sets of data voltages output by the K data driving circuits 12 for display. Herein, the display panel 14 includes a plurality of rows of pixels. In a case where the display panel 14 displays a frame of image data, an i-th row of pixels in the display panel 14 display an i-th row of pixel data in the frame of image data.

The display assembly 10 provided by embodiments of the present disclosure includes K timing controllers 11, K data driving circuits 12 and the display panel 14. A plurality of timing controllers 11 each receive a set of pixel data among the K sets of pixel data into which an i-th row of pixel data in the frame of image data are divided, and thus pixel data with high-bandwidth may be transmitted in a case of limited bandwidth in the transmission technology.

Figure 2A:
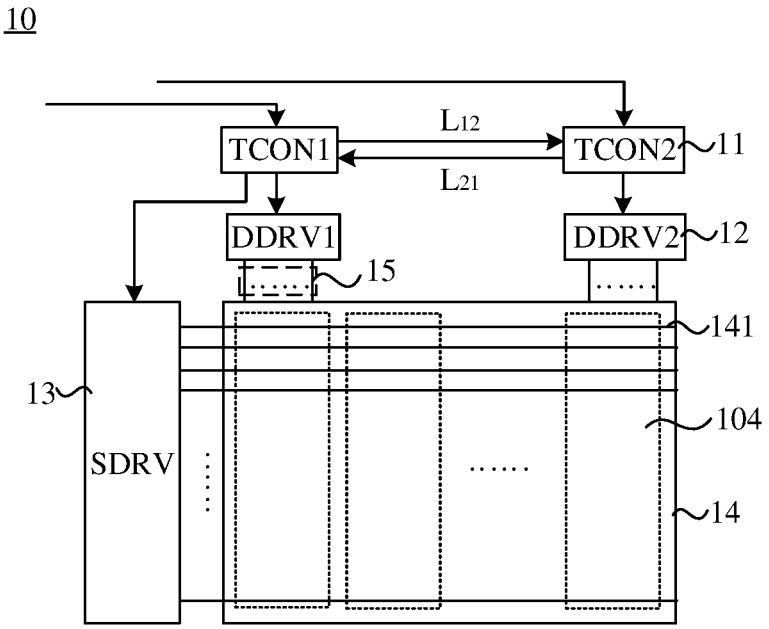
FIG. 2A is a schematic diagram showing a structure of another display assembly, in accordance with some embodiments.
Figure 2B:
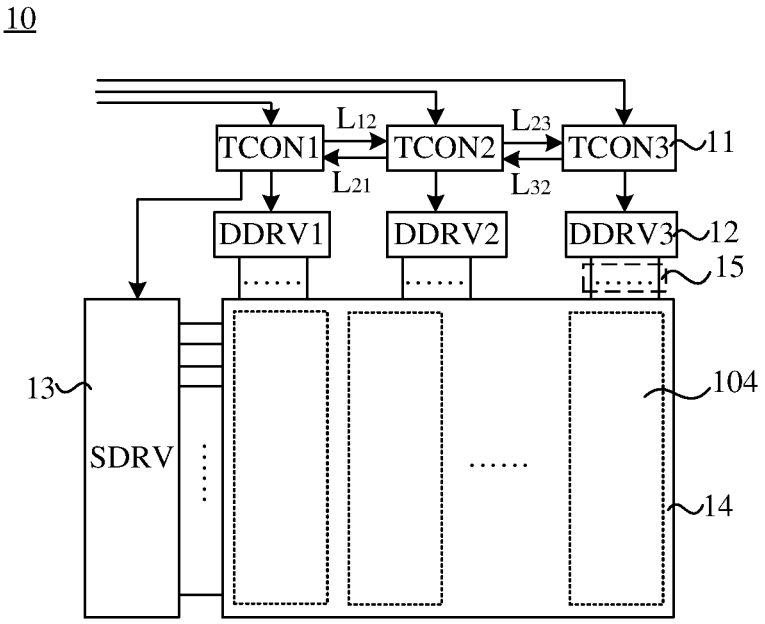
FIG. 2B is a schematic diagram showing a structure of yet another display assembly, in accordance with some embodiments.
Figure 2C:
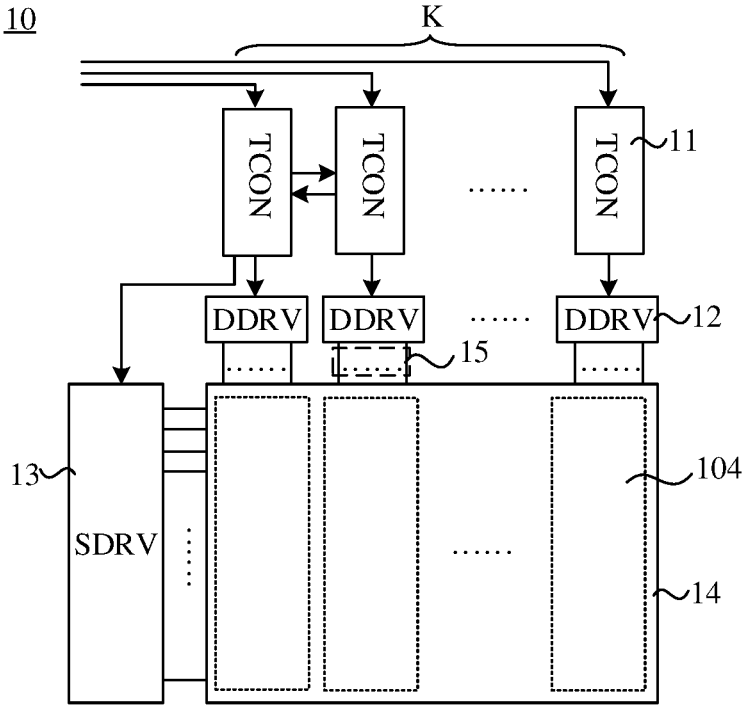
FIG. 2C is a schematic diagram showing a structure of yet another display assembly, in accordance with some embodiments.

In some embodiments, as shown in FIGS. 2A to 2C, the display assembly 10 further includes a gate driving circuit 13. The gate driving circuit 13 is electrically connected to a timing controller 11 in the K timing controllers 11 and the display panel 14. The timing controller 11 connected to the gate driving circuit is further configured to transmit a control signal to the gate driving circuit 13, and the gate driving circuit 13 is configured to output a gate scanning signal to the display panel 14 according to the control signal received from the timing controller 11 connected to the gate driving circuit 13, so that when a gate line, connected to the i-th row of pixels, in the display panel 14 receives the gate scanning signal, the i-th row of pixels in the display panel 14 receive the K sets of data voltages from the K data driving circuits for display.

Herein, the control signal from the timing controller 11 connected to the gate driving circuit 13 is output by the timing controller 11 connected to the gate driving circuit 13 according to states of (K−1) timing controllers 11 other than the timing controller 11 among the K timing controllers 11.

In some examples, as shown in FIG. 2A, the display assembly 10 includes two timing controllers 11 (denoted as TCON1 and TCON2), and two data driving circuits 12 (denoted as DDRV1 and DDRV2). The TCON1 is connected to the DDRV1, and the TCON2 is connected to the DDRV2. The gate driving circuit 13 is connected to the TCON1. The TCON1 outputs a control signal according to a state of the TCON2 to control the gate driving circuit 13, that is, the gate driving circuit 13 outputs a gate scanning signal to the display panel 14 according to the control signal.

Of course, the gate driving circuit 13 may be connected to the TCON2. Based on this, similar to a case where the gate driving circuit 13 is connected to the TCON1, the TCON2 outputs a control signal according to a state of the TCON1 to control the gate driving circuit 13.

For example, the TCON1 includes two ports, the TCON2 includes two ports, and the ports of the TCON1 and the ports of the TCON2 are connected in pairs to form two connecting lines $L_{12}$ and $L_{21}$. The $L_{12}$ is configured to transmit a signal indicating the state of the TCON1 to the TCON2, and the $L_{21}$ is configured to transmit a signal indicating the state of the TCON2 to the TCON1. Herein, the ports are, for example, pins of the timing controller 11.

In the following, by taking an example in which the i-th row of pixel data are divided into two sets of pixel data, the TCON1 receives a first set of pixel data, the TCON2 receives a second set of pixel data, and the gate driving circuit 13 is connected to the TCON1, S11 to S14 are provided to clearly describe a process of the TCON1 controlling the gate driving circuit (SDRV) according to the state of the TCON2.

In S11, after the TCON2 completely outputs the received second set of pixel data to the DDRV2, the TCON2 sends a high-level signal to the TCON1 through the $L_{21}$.

In S12, the TCON1 outputs a control signal to the SDRV in response to the high-level signal received from the TCON2 and a determination that the first set of pixel data has been completely output to the DDRV1, so that the SDRV outputs a gate scanning signal to the display panel 14 in response to the received control signal. As a result, when a gate line connected to the i-th row of pixels in the display panel 14 receives the gate scanning signal, the i-th row of pixels receive a first set of data voltages from the DDRV1 and a second set of data voltages from the DDRV2, that is, the i-th row of pixel data has been transmitted to the display panel 14.

In S13, while outputting the control signal to the SDRV, the TCON1 sends a high-level signal lasting for a period of time to the TCON2 through the $L_{12}$, and then sends a low-level signal, so as to inform the TCON2 that the i-th row of pixel data has been sent.

In S14, the TCON2 sends a low-level signal to the TCON1 through the $L_{21}$ in response to the high-level signal received from the TCON1. After the TCON2 outputs a second set of pixel data in two sets of pixel data into which an (i+1)-th row of pixel data in are divided to the DDRV2, the TCON2 sends a high-level signal to the TCON1 through the $L_{21}$, and so on.

For example, in S13, the TCON1 sends the high-level signal lasting for a period of time to the TCON2 through the $L_{12}$, where the period of time for which the high-level signal lasts is half of a period of time in which the TCON1 transmits the first set of pixel data in the two sets of pixel data into which the i-th row of pixel data are divided to the DDRV1. In this way, it may be prevented that the high-level signal is too short in duration and thus cannot be detected by TCON2. It will be noted that in a case where the gate driving circuit 13 is connected to the TCON2, a process in which the TCON2 outputs a control signal according to the state of the TCON1 to control the gate driving circuit 13 is similar to the process of the above S11 to S14, which will not be repeated herein.

In some other examples, as shown in FIG. 2B, the display assembly 10 includes three timing controllers 11 (denoted as TCON1, TCON2 and TCON3), and three data driving circuits (denoted as DDRV1, DDRV2 and DDRV3). The TCON1 is connected to the DDRV1, the TCON2 is connected to the DDRV2, and the TCON3 is connected to the DDRV3. The gate driving circuit 13 is connected to the TCON1. The TCON1 outputs a control signal according to states of the TCON2 and the TCON3 to control the gate driving circuit 13, that is, the gate driving circuit 13 outputs a gate scanning signal to the display panel 14 according to the control signal.

Of course, the gate driving circuit 13 may be connected to the TCON2 or the TCON3, which is not limited in the embodiments of the present disclosure. For example, the gate driving circuit 13 is connected to the TCON3. Based on this, similar to a case where the gate driving circuit 13 is connected to the TCON1, the TCON3 outputs a control signal according to states of the TCON1 and the TCON2 to control the gate driving circuit 13. For another example, the gate driving circuit 13 is connected to the TCON2. Based on this, similar to the case where the gate driving circuit 13 is connected to the TCON1, the TCON2 outputs a control signal according to states of the TCON1 and the TCON3 to control the gate driving circuit 13.

For example, the TCON1 includes two ports, the TCON2 includes four ports, and the TCON3 includes two ports. The ports of the TCON1 and some ports of the TCON2 are connected in pairs to form two connecting lines $L_{12}$ and $L_{21}$. The $L_{12}$ is configured to transmit a signal indicating a state of the TCON1 to the TCON2, and the $L_{21}$ is configured to transmit a signal indicating a state of the TCON2 to the TCON1. The ports of the TCON2 and the other ports of the TCON3 are connected in pairs to form two connecting lines $L_{23}$ and $L_{32}$. The $L_{23}$ is configured to transmit a signal indicating the state of the TCON2 to the TCON3, and the $L_{32}$ is configured to transmit a signal indicating a state of the TCON3 to the TCON2. Each port is, for example, a pin of each timing controller 11.

In the following, by taking an example in which the i-th row of pixel data are divided into three sets of pixel data, the TCON1 receives a first set of pixel data, the TCON2 receives a second set of pixel data, the TCON3 receives a third set of pixel data, and the gate driving circuit 13 is connected to the TCON1, S21 to S26 are provided to clearly describe a process of the TCON1 controlling the SDRV according to the states of the TCON2 and the TCON3.

In S21, after the TCON3 completely outputs the received third set of pixel data to the DDRV3, the TCON3 sends a high-level signal to the TCON2 through the $L_{32}$.

In S22, after the TCON2 completely outputs the received second set of pixel data to the DDRV2, the TCON2 sends a high-level signal to the TCON1 through the $L_{21}$ in response to the high-level signal received from the TCON3.

In S23, the TCON1 outputs a control signal to the SDRV in response to the high-level signal received from the TCON2 and a determination that the first set of pixel data has completely been output to the DDRV1, so that the SDRV outputs a gate scanning signal to the display panel 14 in response to the received control signal. As a result, when a gate line connected to the i-th row of pixels in the display panel 14 receives the gate scanning signal, the i-th row of pixels receive a first set of data voltages from the DDRV1, a second set of data voltages from the DDRV2 and a third set of data voltages from the DDRV3, that is, the i-th row of pixel data has been transmitted to the display panel 14.

In S24, while outputting the control signal to the SDRV, the TCON1 sends a high-level signal lasting for a period of time to the TCON2 through the $L_{12}$, and then sends a low-level signal to inform the TCON2 that the i-th row of pixel data has been sent.

In S25, the TCON2 sends a high-level signal for a period of time to the TCON3 through the $L_{23}$, and then sends a low-level signal in response to the high-level signal received from the TCON1, so as to inform the TCON3 that the i-th row of pixel data has been sent; and simultaneously, the TCON2 sends a low-level signal to the TCON1 through the $L_{21}$.

In S26, the TCON3 sends a low-level signal to the TCON2 through the $L_{32}$ in response to the high-level signal received from the TCON2. After the TCON3 outputs a third set of pixel data in three sets of pixel data into which the (i+1)-th row of pixel data are divided to the DDRV3, the TCON3 then sends a high-level signal to the TCON2 through the $L_{32}$, and so on.

For example, in S24, the TCON1 sends the high-level signal lasting for a period of time to the TCON2 through the $L_{12}$, where the period of time for which the high-level signal lasts is half of a period of time in which the TCON1 transmits the first set of pixel data in the three sets of pixel data into which the i-th row of pixel data are divided to the DDRV1. And in S25, the TCON2 sends a high-level signal lasting for a period of time to the TCON3 through the $L_{23}$, where the period of time for which the high-level signal lasts is half of a period of time in which the TCON2 transmits the second set of pixel data in the three sets of pixel data into which the i-th row of pixel data are divided to the DDRV2.

In this way, it may be prevented that the high-level signals are too short in duration and thus cannot be detected by the TCON2 and the TCON3.

It will be noted that in a case where the gate driving circuit 13 is connected to the TCON3, a process in which the TCON3 outputs a control signal according to the states of the TCON1 and the TCON2 to control the gate driving circuit 13 is similar to the process of the above S21 to S26, which will not be repeated herein.

In yet some other examples, as shown in FIG. 2C, the display assembly 10 includes K timing controllers 11 (denoted as TCON1, TCON2, . . . , TCONK) and K data driving circuits (denoted as DDRV1, DDRV2, . . . , DDRVK). The TCON1 is connected to the DDRV1, the TCON2 is connected to the DDRV2, and the TCONK is connected to the DDRVK. The gate driving circuit 13 is connected to the TCON1. The TCON1 outputs a control signal according to states of the TCON2 to the TCONK to control the gate driving circuit 13, that is, the gate driving circuit 13 outputs a gate scanning signal to the display panel 14 according to the control signal.

Figure 3:
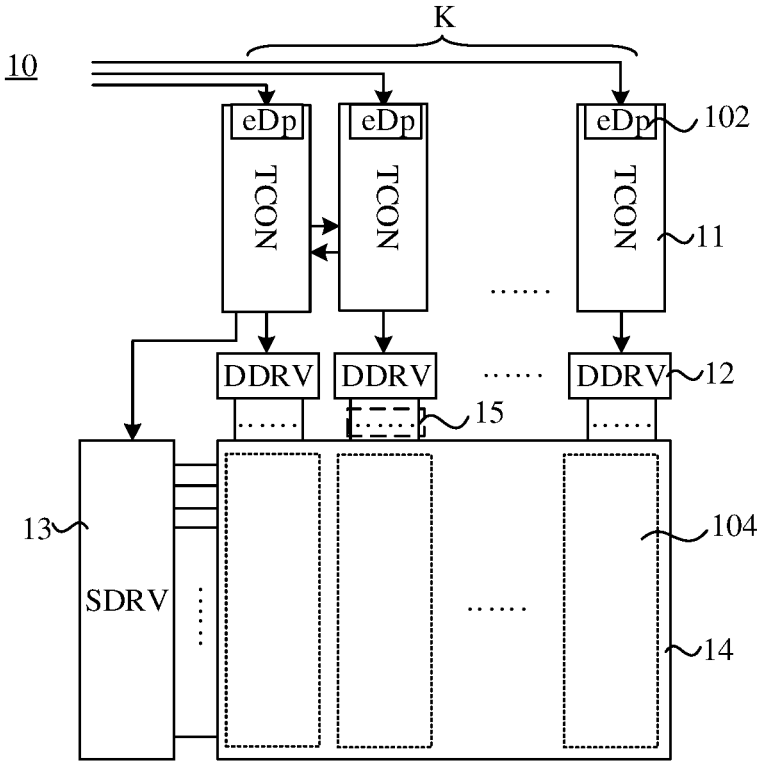
FIG. 3 is a schematic diagram showing a structure of yet another display assembly, in accordance with some embodiments.

In some embodiments, as shown in FIG. 3, each timing controller 11 includes a first embedded display port (eDp) interface 102. Each first eDp interface 102 is configured to receive the set of pixel data among the K sets of pixel data into which the i-th row of pixel data in the frame of image data are divided. For example, a first eDp interface 102 of the first timing controller 11 receives a first set of pixel data among the K sets of pixel data into which the i-th row of pixel data in the frame of image data are divided, and a first eDp interface 102 of the second timing controller 11 receives a second set of pixel data among the K sets of pixel data into which the i-th row of pixel data in the frame of image data are divided.

For example, the first eDp interface 102 includes four lanes, and a transmission rate of each lane is one of 1.62 Gbps, 2.7 Gbps and 5.4 Gbps. The transmission rate of the lane is controlled by a clock signal, and for example, in a case where a frequency of the clock signal is A, a transmission rate of a corresponding lane is 1.62 Gbps.

Generally, in a transmission process, one lane, two lanes or four lanes (each lane has the same transmission rate when a plurality of lanes are used for transmission) may be selected for data transmission according to actual demands, so as to support a corresponding resolution. For example, four lanes are selected for a first eDp interface 102 of each timing controller 11 in the embodiments of the present disclosure, and the transmission rate of each lane is 5.4 Gbps, so as to meet a bandwidth requirement for transmitting the frame of image data.

Figure 4:
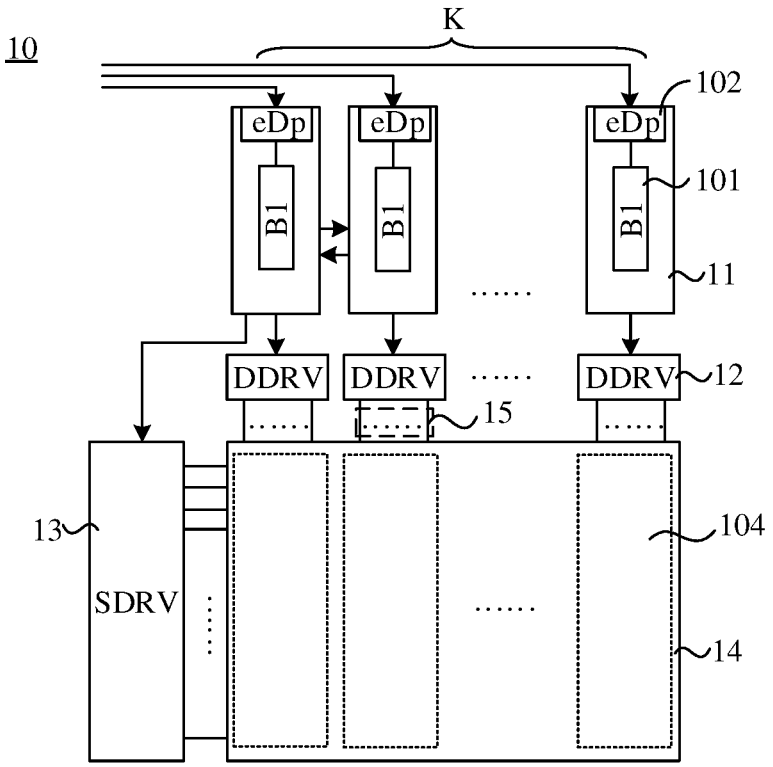
FIG. 4 is a schematic diagram showing a structure of yet another display assembly, in accordance with some embodiments.

In some examples, as shown in FIG. 4, each timing controller 11 further includes a first buffer (as shown by B1 in FIG. 4). Each first buffer 101 is configured to store a set of pixel data received by a respective timing controller 11. That is, each first buffer 101 is configured to store a set of pixel data received by a first eDp interface 102 of a respective timing controller 11.

For example, a first buffer of the first timing controller 11 is configured to store the first set of pixel data among the K sets of pixel data, into which the i-th row of pixel data in the frame of image data are divided, that is received by the first eDp interface 102 of the first timing controller 11, and a first buffer of the second timing controller 11 is configured to store the second set of pixel data among the K sets of pixel data, into which the i-th row of pixel data in the frame of image data are divided, that is received by the first eDp interface 102 of the second timing controller 11.

In some examples, as shown in FIGS. 1 to 4, the display panel 14 has a display area divided into K sub-areas 104 in a row direction of pixels in the display panel 14. All pixels in each sub-area is electrically connected to one data driving circuit 12 in the K data driving circuits.

For example, K data driving circuits 12 are connected to K sets of data lines 15, and each set of data lines 15 is correspondingly connected to a plurality of columns of pixels in a sub-area 104 of the K sub-areas 104. One data driving circuit 12 transmits a set of data voltages to a corresponding plurality of columns of pixels in the i-th row of pixels of the display panel 14 through a set of data lines 15 connected thereto, so that the plurality of columns of pixels display a set of pixel data corresponding to the set of data voltages. In this way, the K sets of pixel data are all displayed at different positions of the i-th row of pixels.

Based on this, each timing controller 11 further includes a memory configured to store the number of pixels in the i-th row of pixels in the sub-area 104 where all the pixels electrically connected to the data driving circuit connected to the timing controller are located.

For example, the number of pixels in the i-th row of pixels in each sub-area 104 of the K sub-areas 104 is equal.

For another example, the number of pixels in the i-th row of pixels in each sub-area 104 of the K sub-areas 104 is not completely equal. Herein, the expression "not completely equal" may be understood that the number of pixels in the i-th row of pixels in a part of sub-areas 104 is equal, and the number of pixels in the i-th row of pixels in another part of sub-areas 104 is different. For example, the number of pixels in the i-th row of pixels in sub-areas from a first sub-area 104 to a (K−1)-th sub-area 104 is equal, and the number of pixels in the i-th row of pixels in a K-th sub-area 104 is not equal to the number of pixels in the i-th row of pixels in the first sub-area 104.

In some examples, a memory in each timing controller is further configured to store display port configuration data (DPCD) of the timing controller. The DPCD includes the number of lanes of the first eDp interface and a transmission rate of each lane.

Figure 5:
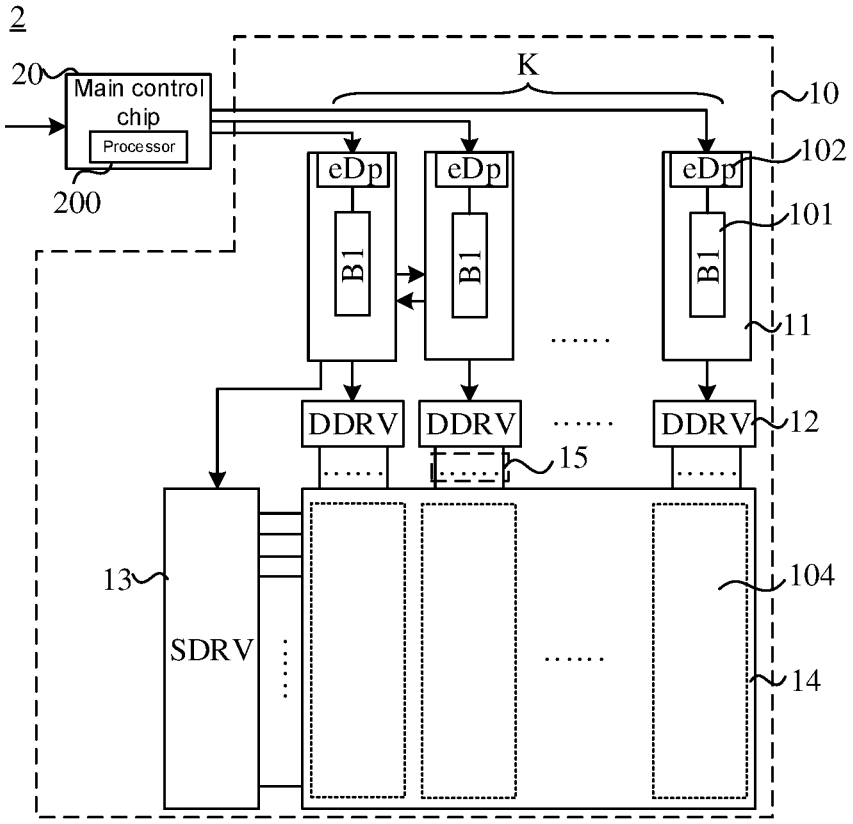
FIG. 5 is a schematic diagram showing a structure of a display apparatus, in accordance with some embodiments.

Some embodiments of the present disclosure provide a display apparatus 2. As shown in FIG. 5, the display apparatus 2 includes a main control chip 20 and the display assembly 10 as described in any of the above embodiments.

The main control chip 20 includes a processor. The processor is configured to receive the above frame of image data, divide the i-th row of pixel data in the frame of image data into K sets of pixel data, and transmit the K sets of pixel data to the K timing controllers in the display assembly 10 simultaneously.

For example, when receiving the frame of image data, the processor first receives a first row of pixel data, then receives a second row of pixel data, . . . , and finally receives a last row of pixel data in the frame of image data. When receiving the i-th row of pixel data in the frame of image data, the processor first receives a first pixel datum in the row of pixel data, then receives a second pixel datum in the row of pixel data, . . . , and finally receives a last pixel datum in the row of pixel data. Therefore, the processor divides the i-th row of pixel data into K sets of pixel data while receiving the i-th row of pixel data. For example, the received data from the first pixel datum to an S-th pixel datum are classified as a first set of pixel data, and the received data from an (S+1)-th pixel datum to a 2S-th pixel datum are classified as a second set of pixel data. That is, the processor completes a process of dividing the i-th row of pixel data into K sets of pixel data while receiving the i-th row of pixel data, and then simultaneously outputs the K sets of pixel data to corresponding timing controllers 11 in the display assembly 10.

The display apparatus 2 provided by the embodiments of the present disclosure divides the i-th row of pixel data into K sets of pixel data, and sends the K sets of pixel data to the display assembly 10 simultaneously, so that pixel data with high-bandwidth may be transmitted in a case of limited bandwidth in the transmission technology.

Figure 6:
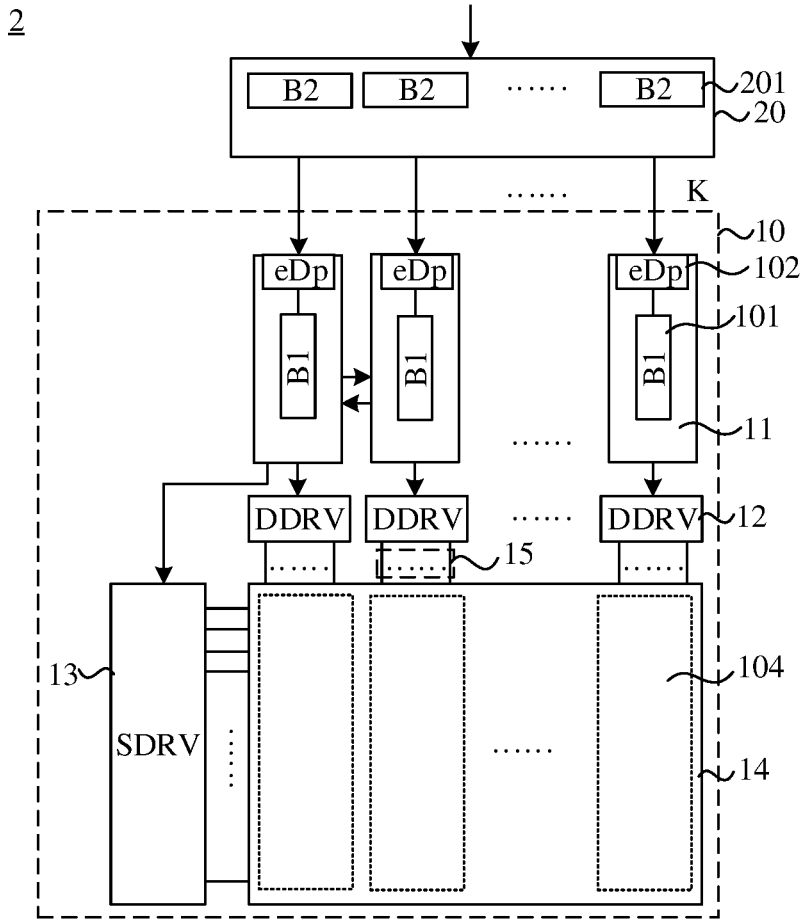
FIG. 6 is a schematic diagram showing a structure of another display apparatus, in accordance with some embodiments.

In some embodiments, as shown in FIG. 6, the main control chip 20 includes K second buffers 201 (as shown by B2 in FIG. 6). It is assumed that the i-th row of pixel data include M pixel data.

The processor is further configured to sequentially and respectively store every S pixel data in the pixel data from the first pixel datum to an M-th pixel datum among the i-th row of pixel data into a second buffer 201 in second buffers 201 from a first second buffer 201 to a (K−1)-th second buffer 201; where M is greater than a product of (K−1) and S and is less than or equal to a product of K and S ($(K-1)\times S<M\leq K\times S$), and S and M are both positive integers. That is, S pixel data in each second buffer from the first second buffer to the (K−1)-th second buffer constitute a set of pixel data, that is, S pixel data in the first second buffer are the first set of pixel data in the i-th row of pixel data, S pixel data in the second second buffer are the second set of pixel data in the i-th row of pixel data, . . . , and S pixel data in the (K−1)-th second buffer are the (K−1) sets of pixel data in the i-th row of pixel data.

The processor is further configured to store pixel data from a $[(K-1)\times S+1]$-th pixel datum to an M-th pixel datum among the i-th row of pixel data into a K-th second buffer 201.

In some examples, the processor is further configured to generate $S-[M-(K-1)\times S]$ virtual pixel data, and store the $S-[M-(K-1)\times S]$ virtual pixel data into the K-th second buffer 201. That is, the pixel data from the $[(K-1)\times S+1]$-th pixel datum to the M-th pixel datum and the $S-[M-(K-1)\times S]$ virtual pixel data, which are in the K-th second buffer, constitute a set of pixel data, i.e., the K-th set of pixel data in the i-th row of pixel data.

For example, the processor generates the S−[M−(K−1)×S] virtual pixel data according to a case where the i-th row of pixel data are divided into K sets of pixel data. Herein, the S−[M−(K−1)×S] virtual pixel data stored in the K-th second buffer 201 is not used for display.

Figure 7:
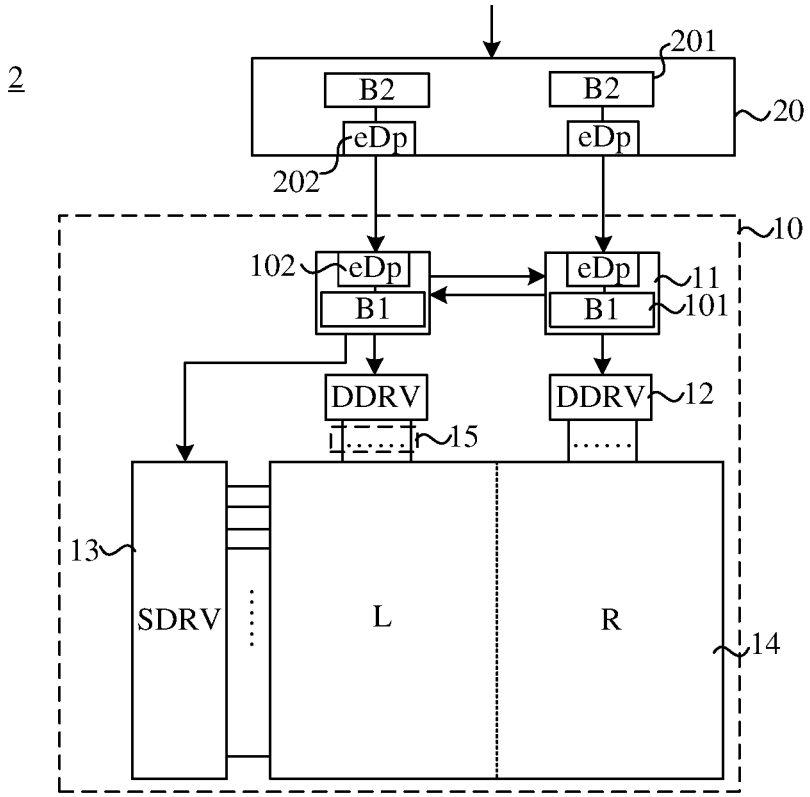
FIG. 7 is a schematic diagram showing a structure of yet another display apparatus, in accordance with some embodiments.

For example, as shown in FIG. 7, a resolution of the display panel 14 is 3440×1440, and the display area of the display panel 14 is divided into two sub-areas. Based on this, the display assembly 10 includes two timing controllers 11, and widths of the sub-areas (the L area and the R area as shown in FIG. 7) of the display panel controlled by the two timing controllers 11 are both 1720, that is, the number of pixels in the i-th row of pixels in each sub-area is 1720. In this case, the i-th row of pixel data are equally divided by the processor and stored in corresponding second buffers 201, that is, the processor stores the pixel data from the first pixel datum to the 1720th pixel among the i-th row of pixel data into the first second buffer 201, and stores the pixel data from the 1721th pixel datum to the 3440th pixel datum into the second second buffer 201.

For another example, the display area of the display panel 14 is divided into two sub-areas, and widths of the sub-areas of the display panel controlled by two timing controllers 11 are each 1728, which is not equal to half of a width of the display panel 14. In this case, the processor divides the i-th row of pixel data into two sets of pixel data. A first set of pixel data includes 1728 pixel data, and a second set of pixel data includes 1712 pixel data. In this case, in a process where the processor transmits the two sets of pixel data to the timing controllers 11, transmission durations of the two sets of pixel data are different, and the problem of pixel data loss may occur. Therefore, the processor generates 16 virtual pixel data, and stores the 16 virtual pixel data into an end of the second set of pixel data into the second second buffer 201, so that the number of pixel data included in the two sets of pixel data is the same, and the transmission durations are the same, which may avoid the problem of pixel data loss in the transmission process.

Figure 8:
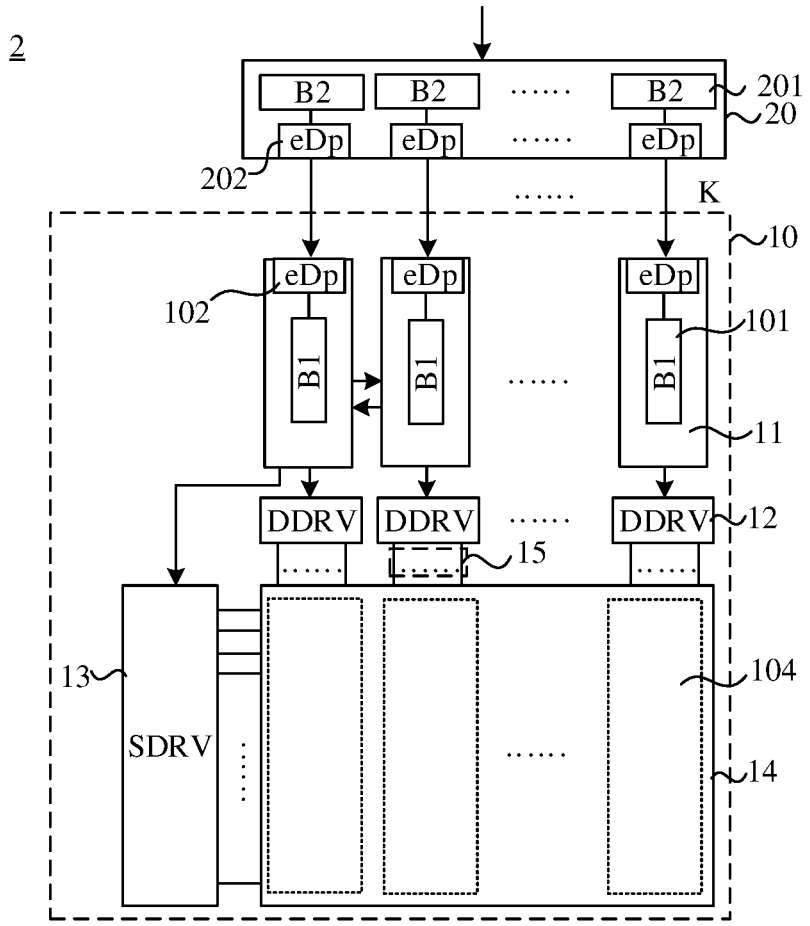
FIG. 8 is a schematic diagram showing a structure of yet another display apparatus, in accordance with some embodiments.

In some examples, as shown in FIG. 8, the main control chip 20 further includes K second eDp interfaces 202. A second eDp interface 202 in the K second eDp interfaces 202 is connected to a first eDp interface 102 of a timing controller 11 in the K timing controllers 11. For example, a first second eDp interface 202 in the main control chip 20 is connected to the first eDp interface 102 of the first timing controller 11 in the display assembly 10. For another example, a second second eDp interface 202 in the main control chip 20 is connected to the first eDp interface 102 of the second timing controller 11 in the display assembly 10.

The processor is further configured to output a set of pixel data among the K sets of pixel data into which the i-th row of pixel data are divided to a corresponding timing controller 11 through a second eDp interface in the K second eDp interfaces 202.

In some embodiments, the processor is further configured to read the number of pixels in the i-th row of pixels in a sub-area 104 corresponding to the timing controller 11 stored in each timing controller 11 through an auxiliary (AUX) channel, so that the processor divides the i-th row of pixel data corresponding to the i-th row of pixels into K sets of pixel data according to the number of pixels in the i-th row of pixels.

In addition, the processor is further configured to read extended display identification data (EDID) of the display panel 14 through the AUX channel. The EDID includes basic parameters of performances of each display assembly 10, such as manufacturer identification code, product identification code, manufacturing time, maximum display size, color settings, frequency limitations, and supported resolution. A display capability of the display panel 14 is obtained by acquiring the EDID, so that the main control chip 20 outputs data matched with the EDID to the display assembly 10, so as to make the display panel 14 display images normally.

It will be noted that, if the main control chip 20 and the timing controllers 11 in the display assembly 10 have agreed in advance on the number of pixels in the i-th row of pixels in a sub-area 104, corresponding to each timing controller 11, of the display panel 14 and a corresponding relationship between the number and each sub-area 104, the processor may not read the number of pixels in the i-th row of pixels in a sub-area 104 corresponding to the timing controller 11 stored in each timing controller 11, and the main control chip 20 may directly divide the i-th row of pixel data according to the agreed information and then transmit the divided pixel data to the corresponding timing controllers 11 in the display assembly 10. In this way, a display speed at which the display panel displays the i-th row of pixel data may be accelerated.

In some examples, the processor is further configured to read DPCD of each timing controller through the AUX channel, and obtain a state of the first eDp interface 102 of the timing controller 11 according to the read DPCD.

Herein, obtaining the state of the first eDp interface 102 of the timing controller 11 refers to determining transmission parameters of the first eDp interface 102, such as the number of lanes, a transmission rate of each lane, voltage swing, pre-emphasis, equalization and clock recovery.

Based on this, the processor calculates a total bandwidth currently supported by the timing controller 11 by multiplying the number of lanes by the transmission rate of each lane. Generally, the transmission rate of each lane is equal.

It will be noted that the processor may read the DPCD through the AUX channel a plurality of times to play a role in fool-proofing.

In some examples, the processor is further configured to receive a hot-plug detection (HPD) signal from each of the K timing controllers 11 in the display assembly 10 to determine whether each timing controller 11 is connected to the main control chip 20.

For example, that the processor receives the HPD signal from each timing controller 11 refers to that the processor receives the HPD signal from the first eDp interface 102 of each timing controller 11 through the second eDp interface 202.

For a HPD signal from a timing controller 11, the processor determines that the corresponding timing controller 11 is not connected to the main control chip 20, in response to that the received HPD signal is always a low-level signal. In this case, a handshake process (training) between the main control chip 20 and the timing controller 11 will not be performed. The processor determines that the corresponding timing controller 11 is connected to the main control chip 20, in response to that the received HPD signal is a high-level signal and is a low-level signal lasting for 100 ms or more before the high-level signal, and thus the i-th row of pixel data may be transmitted.

For example, during a period when the HPD signal received by the processor is a high-level signal, a low-level signal that lasts for less than 2 ms occurs. This situation is taken as a trigger condition for the processor to read the DPCD through the AUX channel. That is, the processor re-reads the DPCD, in response to that the received HPD signal from the timing controller 11 is a high-level signal, then the received HPD signal from the timing controller 11 is a low-level signal lasting for less than 2 ms, and afterwards the received HPD signal from the timing controller 11 is a high-level signal again.

Based on this, the processor transmits the i-th row of pixel data to the first eDp interface 102 of the corresponding timing controller 11 through the second eDp interface 202 according to results of the handshake processes (trainings) between the K second eDp interfaces 202 and the first eDp interface 102 corresponding to each timing controller 11.

Herein, the handshake process (training) includes processes that the processor reads the EDID through the AUX channel, reads the DPCD through the AUX channel, and receives the HPD signal.

Some embodiments of the present disclosure provide a display method of a data signal, and the display method includes S10.

In S10, the display panel receives K sets of data voltages output by K data driving circuits 12 for display. A set of data voltages in the K sets of data voltages is output by each data driving circuit 12 in the K data driving circuits 12 according to a set of pixel data received from a corresponding timing controller 11, and the set of pixel data is a set of pixel data among the K sets of pixel data.

The display method of the data signal provided by the embodiments of the present disclosure has the same beneficial effects as the display assembly 10, which will not be repeated herein.

In some embodiments, the display method further includes S20.

In S20, a gate line connected to the i-th row of pixels in the display panel 14 receives a gate scanning signal from the gate driving circuit 13, so that the i-th row of pixels receive the K sets of data voltages for display when the gate line connected to the i-th row of pixels receives the gate scanning signal.

The gate scanning signal is output by the gate driving circuit 13 according to a control signal received from the timing controller 11 connected to the gate driving circuit 13. The control signal from the timing controller 11 is output according to states of (K−1) timing controllers 11 other than the timing controller 11 connected to the gate driving circuit among the K timing controllers 11.

Figure 9:
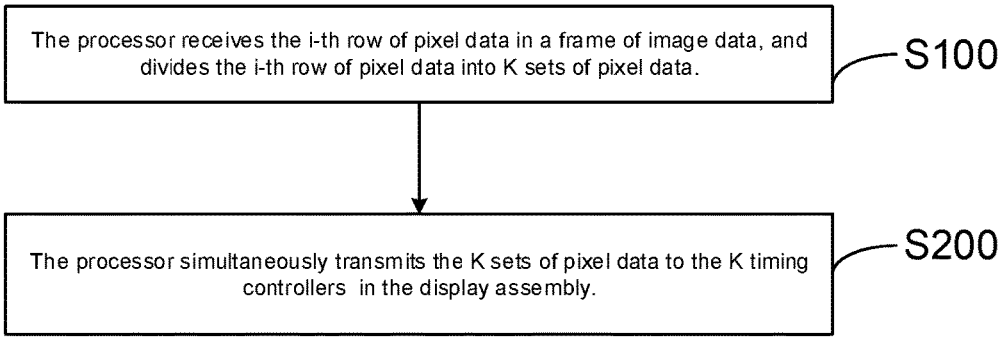
FIG. 9 is a schematic flow chart of a transmission method of a data signal, in accordance with some embodiments.

Some embodiments of the present disclosure provide a transmission method of a data signal. As shown in FIG. 9, the transmission method includes S100 to S200.

In S100, the processor receives the i-th row of pixel data in a frame of image data, and divides the i-th row of pixel data into K sets of pixel data.

For example, the frame of image data includes 1440 rows of pixel data, and each row of pixel data includes 3440 pixel data. The processor first receives pixel data from a first pixel datum to a 3440th pixel datum in a first row, and then receives pixel data from a first pixel datum to a 3440th pixel datum in a second row, and so on.

For another example, when receiving a first row of pixel data, the processor first receives the first pixel datum in the first row of pixel data, then receives the second pixel datum, . . . , and finally receives the 3440th pixel datum.

In S200, the processor simultaneously transmits the K sets of pixel data to the K timing controllers 11 in the display assembly 10.

The transmission method of the data signal provided by the embodiments of the present disclosure has the same beneficial effects as the display apparatus 2, which will not be repeated herein.

Figure 10:
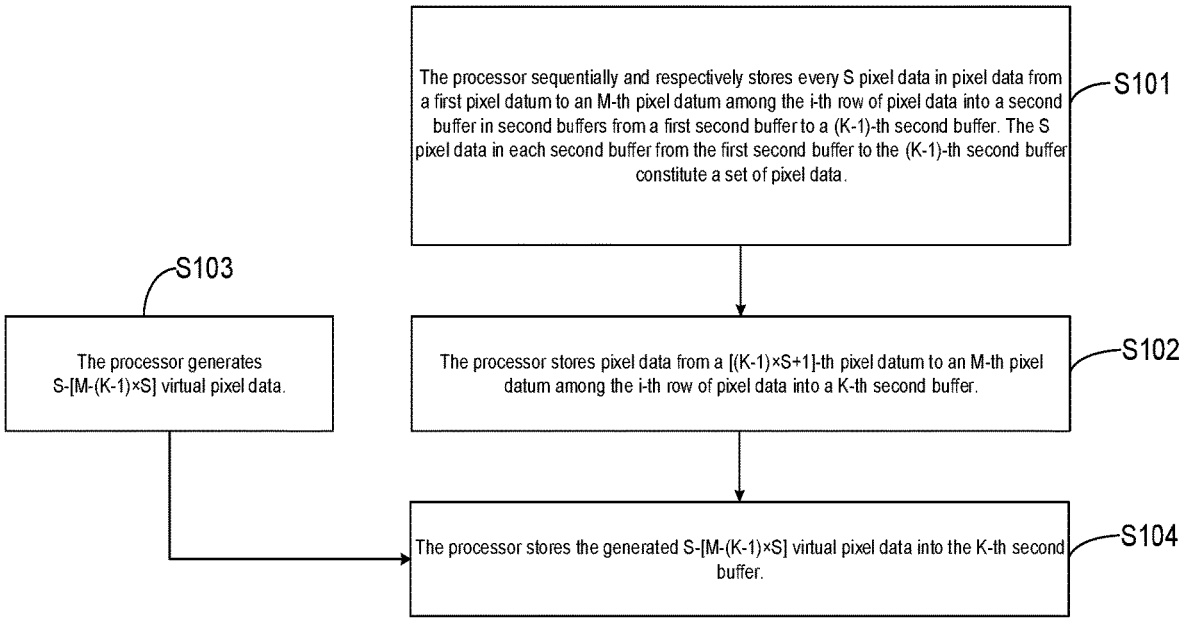
FIG. 10 is a schematic flow chart of another transmission method of a data signal, in accordance with some embodiments.

In some embodiments, as shown in FIG. 10, the transmission method further includes S101 to S102.

In S101, the processor sequentially and respectively stores every S pixel data in pixel data from a first pixel datum to an M-th pixel datum among the i-th row of pixel data into a second buffer in second buffers from a first second buffer 201 to a (K−1)-th second buffer 201. The S pixel data in each second buffer from the first second buffer to the (K−1)-th second buffer constitute a set of pixel data.

In S102, the processor stores pixel data from a [(K−1)×S+1]-th pixel datum to an M-th pixel datum among the i-th row of pixel data into a K-th second buffer 201.

In some embodiments, as shown in FIG. 10, the transmission method further includes S103 to S104.

In S103, the processor generates S−[M−(K−1)×S] virtual pixel data.

In S104, the processor stores the generated S−[M−(K−1)×S] virtual pixel data into the K-th second buffer 201.

In some examples, the S200 includes:

outputting, by the processor, the K sets of pixel data stored in the K second buffers 201 through the K second eDp interfaces 202 simultaneously and respectively to first eDp interfaces of corresponding timing controllers 11 in the K timing controllers 11 in the display assembly 10.

For example, the processor receives 1440 rows of pixel data, and each row of pixel data includes 3440 pixel data.

In a case where the main control chip 20 includes two second buffers 201, each of which stores 1728 pixel data. The processor first receives the first pixel datum in the first row of pixel data and stores it in one second buffer 201, and the processor continues receiving pixel data and stores them in the one second buffer 201, until the processor receives a 1728th pixel datum in the first row of pixel data and stores it in the one second buffer 201; here, pixel data from the first pixel datum to the 1728th pixel datum that are stored in the one second buffer 201 are a first set of pixel data in the first row of pixel data. Then the processor receives a 1729th pixel datum and stores it in the other second buffer 201, and the processor continues receiving pixel data and storing them in the other second buffer 201, until the processor receives a 3440th pixel datum and stores it in the other second buffer 201, and afterwards the processor continues to store 16 virtual pixel data in the other second buffer 201; here, pixel data from the 1729th pixel datum to the 3440th pixel datum and the 16 virtual pixel data, which are stored in the other second buffer 201, are a second set of pixel data in the first row of pixel data.

After the first row of pixel data is completely stored, when waiting to receive a second row of pixel data and store the second row of pixel data in the second buffer 201, the processor starts to simultaneously send the two sets of pixel data, stored in the two second buffers 201, in first row of pixels to the first eDp interfaces 102 of corresponding timing controllers 11 through two second eDp interfaces 202, respectively, and so on.

In some embodiments, before the S100, the transmission method of the data signal further includes S003.

In S003, the processor reads the number of pixels in a row of pixels in a sub-area 104 corresponding to each timing controller 11 stored in each timing controller 11, so that the processor divides the i-th row of pixel data corresponding to the i-th row of pixels into K sets of pixel data according to the number of pixels in the i-th row of pixels in a sub-area 104 corresponding to each timing controller 11.

In some examples, the S103 is performed after the S003, and the S103 may be performed simultaneously with the S100.

In some embodiments, before the S100, the transmission method of the data signal further includes S002.

In S002, the processor reads the DPCD through the AUX channel, and obtains a state of the first eDp interface of the timing controller 11 according to the DPCD.

In some examples, before the S002, the transmission method of the data signal further includes S001.

In S001, the processor receives a HPD signal from each of the K timing controllers 11 in the display assembly 10, and determines whether a corresponding timing controller 11 is connected to the main control chip 20 according to the HPD signal from each timing controller 11.

Figure 11:
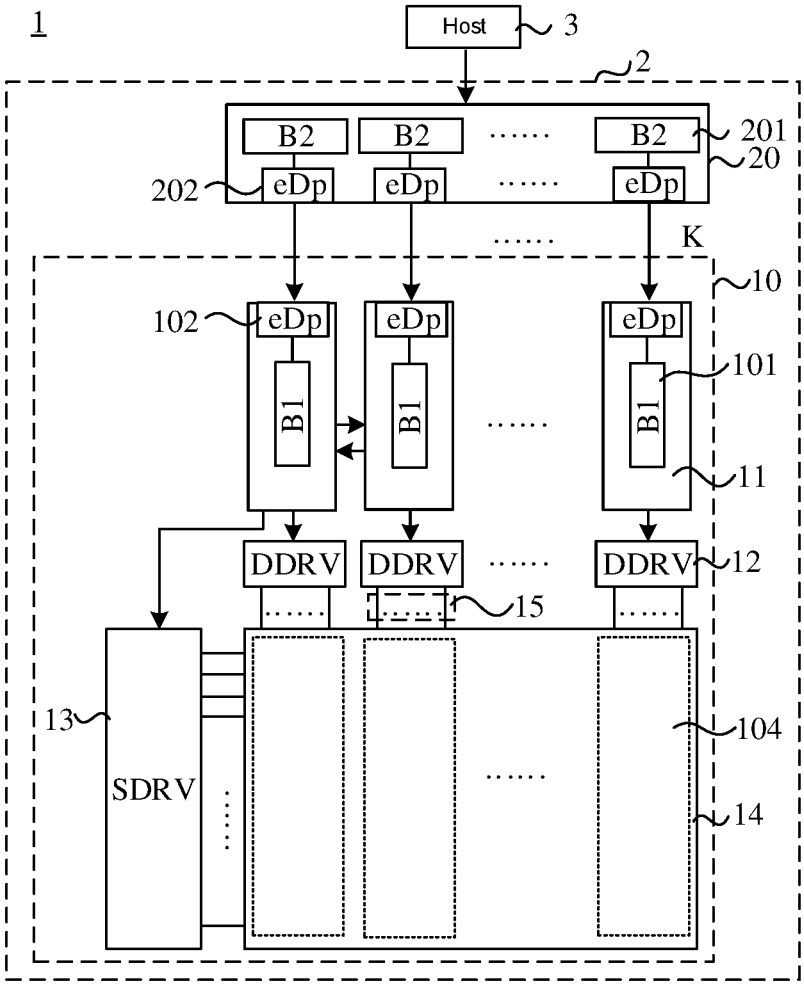
FIG. 11 is a schematic diagram showing a structure of a display system, in accordance with some embodiments.

Some embodiments of the present disclosure provide a display system 1. As shown in FIG. 11, the display system 1 includes a host 3 and the display apparatus 2 in any of the above embodiments connected to the host 3.

The host 3 is configured to send the i-th row of pixel data in the frame of image data to the display apparatus 2.

For example, the host 3 transmits the frame of image data to the main control chip 20 in the display apparatus 2, the frame of image data includes 1440 rows of pixel data, and each row of pixel data includes 3440 pixel data.

In the transmission process, the host 3 first transmits the first row of pixel data to the main control chip 20, and after the main control chip 20 finishes receiving, the host 3 continues to transmit the second row of pixel data to the main control chip 20, and so on.

Some embodiments of the present disclosure provide a computer-readable storage medium (e.g., a non-transitory computer-readable storage medium). The computer readable storage medium has stored thereon computer program instructions that, when run on a processor, cause the processor to execute one or more steps in the display method of pixel data as described in any of the above embodiments or one or more steps in the transmission method of pixel data as described in any of the above embodiments.

For example, the computer-readable storage medium may include, but is not limited to a magnetic storage device (e.g., a hard disk, a floppy disk or a magnetic tape), an optical disk (e.g., a compact disk (CD), a digital versatile disk (DVD)), a smart card or a flash memory device (e.g., an erasable programmable read-only memory (EPROM), a card, a stick or a key driver). Various computer-readable storage media described in the present disclosure may represent one or more devices and/or other machine-readable storage media for storing information. The term "machine-readable storage media" may include, but is not limited to, wireless channels and various other media capable of storing, containing and/or carrying instructions and/or data.

The above descriptions are merely some specific implementation manners of the present disclosure, but the protection scope of the present disclosure is not limited thereto, and changes or replacements that any person skilled in the art could conceive of within the technical scope disclosed by the present disclosure shall be within the protection scope of the present disclosure. Therefore, the protection scope of the present disclosure shall be subject to the protection scope of the claims.

What is claimed is:

1. A display apparatus, comprising:

a display assembly; and a main control chip;

wherein the display assembly includes:

K timing controllers, each of the K timing controllers being configured to receive a set of pixel data among K sets of pixel data into which an i-th row of pixel data including M pixel data in a frame of image data are divided, and different timing controllers receiving different sets of pixel data; K being a positive integer greater than or equal to 2, i belonging to a set with elements 1, 2, 3, . . . , n ($i \in \{1, 2, 3, \ldots, n\}$), and n being a positive integer greater than or equal to 1;

K data driving circuits, a data driving circuit in the K data driving circuits being connected to a corresponding timing controller in the K timing controllers; the data driving circuit being configured to receive the set of pixel data from the corresponding timing controller and output a set of data voltage; and a display panel electrically connected to the K data driving circuits, and the display panel being configured to receive K sets of data voltages output by the K data driving circuits for display;

wherein the main control chip includes:

K second buffers; and a processor configured to:

receive the frame of image data;

divide the i-th row of pixel data into the K sets of pixel data;

simultaneously transmit the K sets of pixel data to the K timing controllers in the display assembly;

sequentially and respectively store every S pixel data in pixel data from a first pixel datum to an M-th pixel datum among the i-th row of pixel data into a second buffer in second buffers from a first second buffer to a (K−1)-th second buffer; and store pixel data from a [(K−1)×S+1]-th pixel datum to the M-th pixel datum among the i-th row of pixel data into a K-th second buffer, wherein M is greater than a product of (K−1) and S and is less than or equal to a product of K and S ($(K-1)\times S<M\leq K\times S$), and S and M are both positive integers, and S pixel data in each second buffer from the first second buffer to the (K−1)-th second buffer constitute the set of pixel data.

2. The display apparatus according to claim 1, wherein the display assembly further includes:

a gate driving circuit electrically connected to a timing controller in the K timing controllers and the display panel; wherein the timing controller connected to the gate driving circuit is further configured to transmit a control signal to the gate driving circuit; and the gate driving circuit is configured to output a gate scanning signal to the display panel according to the control signal received from the timing controller connected to the gate driving circuit, so that when a gate line, connected to an i-th row of pixels, in the display panel receives the gate scanning signal, the i-th row of pixels receive the K sets of data voltages for display.

3. The display apparatus according to claim 1, wherein the timing controller includes a first embedded display port (eDp) interface, and the first eDp interface is configured to receive the set of pixel data among the K sets of pixel data into which the i-th row of pixel data in the frame of image data are divided.

4. The display apparatus according to claim 3, wherein the timing controller further includes a first buffer configured to store the set of pixel data received by the timing controller.

5. The display apparatus according to claim 4, wherein the display panel has a display area divided into K sub-areas in a row direction of pixels in the display panel, and all pixels in each sub-area are electrically connected to one data driving circuit in the K data driving circuits; and the timing controller further includes a memory configured to store the number of pixels in an i-th row of pixels in the sub-area where all the pixels electrically connected to the data driving circuit connected to the timing controller are located.

6. The display apparatus according to claim 1, wherein the processor is further configured to generate S−[M−(K−1)×S] virtual pixel data and store the S−[M−(K−1)×S] virtual pixel data into the K-th second buffer; the pixel data from the [(K−1)×S+1]-th pixel datum to the M-th pixel datum and the S−[M−(K−1)×S] virtual pixel data, which are in the K-th second buffer, constitute the set of pixel data.

7. The display apparatus according to claim 6, wherein the main control chip further includes K second embedded display port (eDp) interfaces, and each of the K timing controllers includes a first eDp interface;

a second eDp interface in the K second eDp interfaces is connected to the first eDp interface of one timing controller in the K timing controllers; and the processor is further configured to output the set of pixel data among the K sets of pixel data to the first eDp interface of the corresponding timing controller through the second eDp interface in the K second eDp interfaces.

8. The display apparatus according to claim 7, wherein the display panel has a display area divided into K sub-areas in a row direction of pixels in the display panel, and all pixels in each sub-area are electrically connected to one data driving circuit in the K data driving circuits;

the timing controller includes a memory configured to store the number of pixels in an i-th row of pixels in the sub-area where all the pixels electrically connected to the data driving circuit connected to the timing controller are located; and the processor is further configured to read the number of pixels in the i-th row of pixels in the sub-area corresponding to each timing controller stored in each timing controller, so that the processor divides the i-th row of pixel data corresponding to the i-th row of pixels into the K sets of pixel data according to the number of the pixels in the i-th row of pixels in the sub-area stored in each timing controller.

9. The display apparatus according to claim 8, wherein the memory is further configured to store display port configuration data (DPCD) of the timing controller, the DPCD includes the number of lanes and a transmission rate of each lane; and the processor is further configured to read the DPCD and obtain a state of the first eDp interface of the timing controller according to the DPCD.

10. The display apparatus according to claim 9, wherein the processor is further configured to receive a hot-plug detection signal from each of the K timing controllers to determine whether each timing controller is connected to the main control chip.

11. A transmission method of a data signal of a display apparatus, the display apparatus comprising:

a display assembly; and a main control chip including K second buffers;

wherein the display assembly includes:

K timing controllers, each of the K timing controllers being configured to receive a set of pixel data among K sets of pixel data into which an i-th row of pixel data including M pixel data in a frame of image data are divided, and different timing controllers receiving different sets of pixel data; K being a positive integer greater than or equal to 2, i belonging to a set with elements 1, 2, 3, . . . , n (i∈{1, 2, 3, . . . , n}), and n being a positive integer greater than or equal to 1;

K data driving circuits, a data driving circuit in the K data driving circuits being connected to a corresponding timing controller in the K timing controllers; the data driving circuit being configured to receive the set of pixel data from the corresponding timing controller and output a set of data voltage; and a display panel electrically connected to the K data driving circuits, and the display panel being configured to receive K sets of data voltages output by the K data driving circuits for display;

wherein the transmission method comprises:

receiving, by the processor, the frame of image data;

dividing, by the processor, the i-th row of pixel data into the K sets of pixel data; and transmitting, by the processor, the K sets of pixel data to the K timing controllers in the display assembly simultaneously;

wherein the transmission method further comprises:

storing, by the processor, every S pixel data in pixel data from a first pixel datum to an M-th pixel datum among the i-th row of pixel data sequentially and respectively into a second buffer in second buffers from a first second buffer to a (K−1)-th second buffer; and S pixel data in each second buffer from the first second buffer to the (K−1)-th second buffer constituting the set of pixel data; and storing, by the processor, pixel data from a [(K−1)×S+1]-th pixel datum to the M-th pixel datum among the i-th row of pixel data into a K-th second buffer.

12. The transmission method according to claim 11, further comprising:

generating, by the processor, S−[M−(K−1)×S] virtual pixel data; and storing, by the processor, the S−[M−(K−1)×S] virtual pixel data into the K-th second buffer.

13. The transmission method according to claim 11, wherein the display panel has a display area, the display area is divided into K sub-areas in a row direction of pixels in the display panel, and all pixels in each sub-area are electrically connected to one data driving circuit in the K data driving circuits; the timing controller includes a memory configured to store the number of pixels in an i-th row of pixels in the sub-area where all the pixels electrically connected to the data driving circuit connected to the timing controller are located; and the transmission method further comprises:

reading, by the processor, the number of pixels in a row of pixels in the sub-area corresponding to each timing controller stored in each timing controller, so that the processor divides the i-th row of pixel data corresponding to the i-th row of pixels into the K sets of pixel data according to the number of pixels in the i-th row of pixels in the sub-area corresponding to each timing controller.

14. The transmission method according to claim 11, wherein the timing controller includes a memory configured to store display port configuration data (DPCD) of the timing controller, and the DPCD includes the number of lanes and a transmission rate of each lane; and the transmission method further comprises:

reading, by the processor, the DPCD; and obtaining, by the processor, a state of a first eDp interface of the timing controller according to the DPCD.

15. The transmission method of the data signal according to claim 14, further comprising:

receiving, by the processor, a hot-plug detection signal from each of the K timing controllers; and determining, by the processor, whether the timing controller is connected to the main control chip according to the hot-plug detection signal.

* * * * *